US010919291B2

(12) United States Patent
Kohnotoh et al.

(10) Patent No.: US 10,919,291 B2
(45) Date of Patent: Feb. 16, 2021

(54) PRINTING APPARATUS AND CONTROL METHOD OF PRINTING APPARATUS

(71) Applicant: CANON KABUSHIKI KAISHA, Tokyo (JP)

(72) Inventors: Atsushi Kohnotoh, Kawasaki (JP); Noboru Shimoyama, Yokohama (JP); Takahiro Kiuchi, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 23 days.

(21) Appl. No.: 16/531,356

(22) Filed: Aug. 5, 2019

(65) Prior Publication Data

US 2020/0047493 A1 Feb. 13, 2020

(30) Foreign Application Priority Data

Aug. 10, 2018 (JP) ..... JP2018-151632

(51) Int. Cl.

*B41J 2/045* (2006.01)
*B41J 2/165* (2006.01)
*B41J 25/00* (2006.01)

(52) U.S. Cl.

CPC ..... *B41J 2/04505* (2013.01); *B41J 2/04586* (2013.01); *B41J 2/16505* (2013.01); *B41J 25/006* (2013.01)

(58) Field of Classification Search

CPC .. B41J 2/04505; B41J 25/006; B41J 2/04586; B41J 2/16505; B41J 2/16538; B41J 2/16588; B41J 2/16508

See application file for complete search history.

(56) References Cited

U.S. PATENT DOCUMENTS

| | | | | |
|---|---|---|---|---|
| 5,044,794 | A | 9/1991 | Shimoyama et al. | |
| 5,175,563 | A | 12/1992 | Fushimoto et al. | |
| 7,052,106 | B1 * | 5/2006 | Onuma | B41J 2/165 347/22 |
| 7,097,272 | B2 | 8/2006 | Yoshida et al. | |
| 7,552,993 | B2 | 6/2009 | Shimoyama | |
| 7,566,124 | B2 | 7/2009 | Kan et al. | |
| 10,406,838 | B2 | 9/2019 | Ohashi et al. | |
| 2018/0086121 | A1 * | 3/2018 | Morimoto | B41J 2/16511 |
| 2018/0236791 | A1 | 8/2018 | Ohashi et al. | |
| 2018/0326730 | A1 | 11/2018 | Kohnotoh | |
| 2019/0283434 | A1 | 9/2019 | Kida et al. | |
| 2019/0299589 | A1 | 10/2019 | Kiuchi et al. | |
| 2019/0299596 | A1 | 10/2019 | Kohnotoh | |
| 2019/0299639 | A1 | 10/2019 | Kohnotoh | |
| 2019/0299681 | A1 | 10/2019 | Kurata et al. | |
| 2019/0299687 | A1 | 10/2019 | Kohnotoh et al. | |

FOREIGN PATENT DOCUMENTS

| | | | |
|---|---|---|---|
| JP | 2005-297444 | A | 10/2005 |
| JP | 2010-052177 | A | 3/2010 |

* cited by examiner

*Primary Examiner* — Henok D Legesse
(74) *Attorney, Agent, or Firm* — Venable LLP

(57) ABSTRACT

The printing apparatus comprises: a print head having an ejection opening surface on which an ejection opening configured to eject ink is formed; a holder member that holds the print head; a moving unit configured to move the holder member; a fixing member that fixes the holder member; a detecting unit configured to detect a moving distance of the holder member; and a first determining part configured to determine that the holder member is fixed by the fixing member in a case where the moving distance detected by the detecting unit is less than a predetermined value.

15 Claims, 15 Drawing Sheets

PRINTING APPARATUS AND CONTROL METHOD OF PRINTING APPARATUS

BACKGROUND OF THE INVENTION

Field of the Invention

The present invention relates to a printing apparatus comprising a holder member that holds a print head and a fixing member that fixes the holder member, and a control method of the printing apparatus.

Description of the Related Art

At the time of transport of an inkjet printing apparatus comprising a print head that ejects ink, it is required to prevent misalignment of the print head due to an impact of transport, and therefore, it is desirable to physically fix the position of the print head.

Japanese Patent Laid-Open No. 2010-052177 has disclosed a technique to fix a head holder (holder member) to which a print head is attached at the time of transporting a printing apparatus for repair, relocation, or the like.

In a case where a printing apparatus is installed in a state where a holder member is fixed, a user him/herself cancels the fixed state of the holder member. However, print operation can be started without a user cancelling the fixed state of the holder member. At this time, there is a possibility that the printing apparatus itself is damaged.

SUMMARY OF THE INVENTION

The printing apparatus according to the present invention is a printing apparatus comprising: a print head having an ejection opening surface on which an ejection opening configured to eject ink is formed; a holder member that holds the print head; a moving unit configured to move the holder member; a fixing member that fixes the holder member; a detecting unit configured to detect a moving distance of the holder member; and a first determining part configured to determine that the holder member is fixed by the fixing member in a case where the moving distance detected by the detecting unit is less than a predetermined value.

Further features of the present invention will become apparent from the following description of exemplary embodiments with reference to the attached drawings.

BRIEF DESCRIPTION OF THE DRAWINGS

FIG. 14 is a diagram showing the relationship of FIG. 14A and FIG. 14B;

DESCRIPTION OF THE EMBODIMENTS

Figure 1:
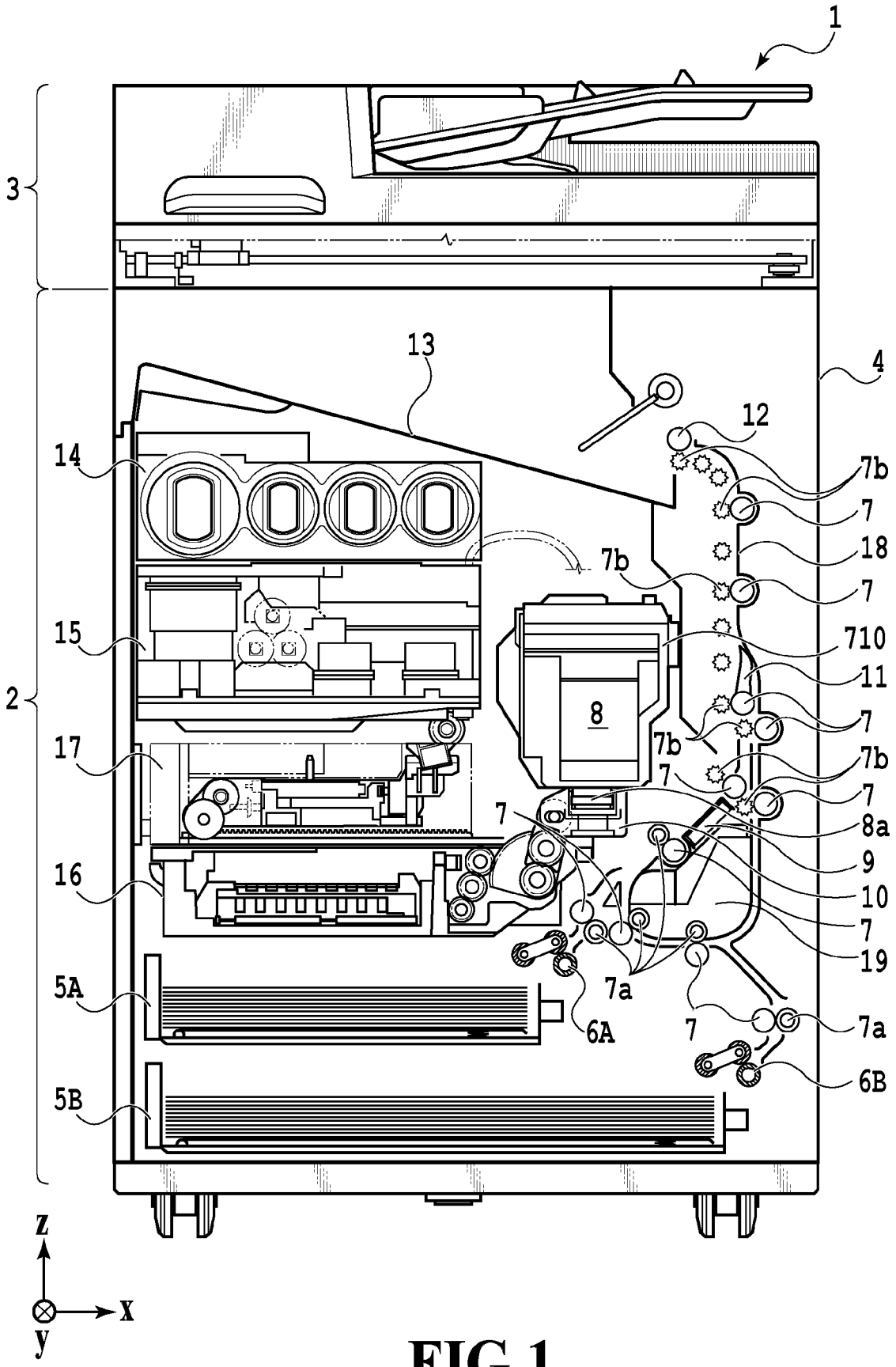
FIG. 1 is a diagram showing a printing apparatus in a standby state.

Embodiments of the present invention will be described with reference to the drawings. It should be noted that the following embodiments do not limit the present invention and that not all of the combinations of the characteristics described in the present embodiments are essential for solving the problem to be solved by the present invention. Incidentally, the same reference numeral refers to the same component in the following description. Furthermore, relative positions, shapes, and the like of the constituent elements described in the embodiments are exemplary only and are not intended to limit the scope of the invention.

First Embodiment

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
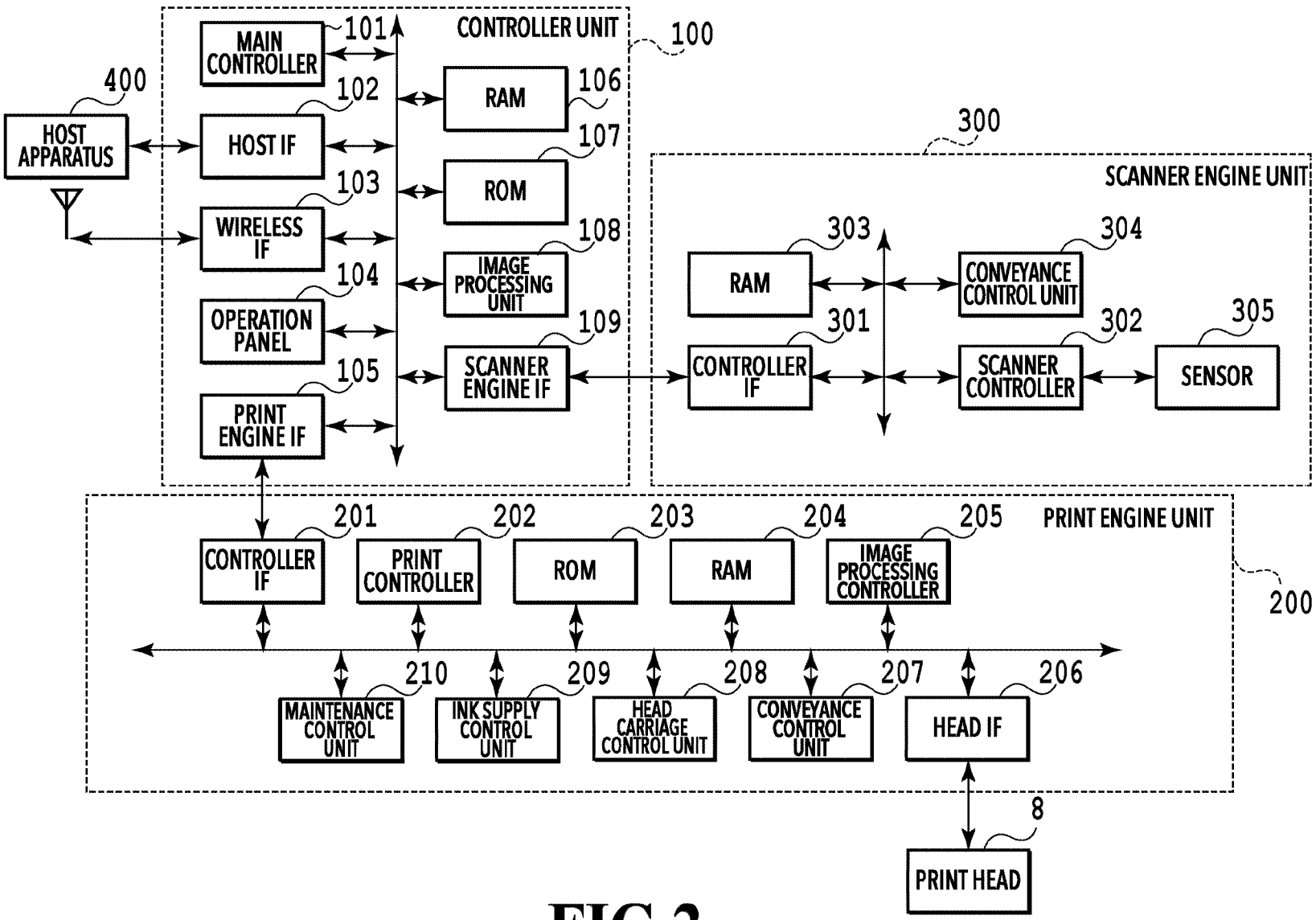
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
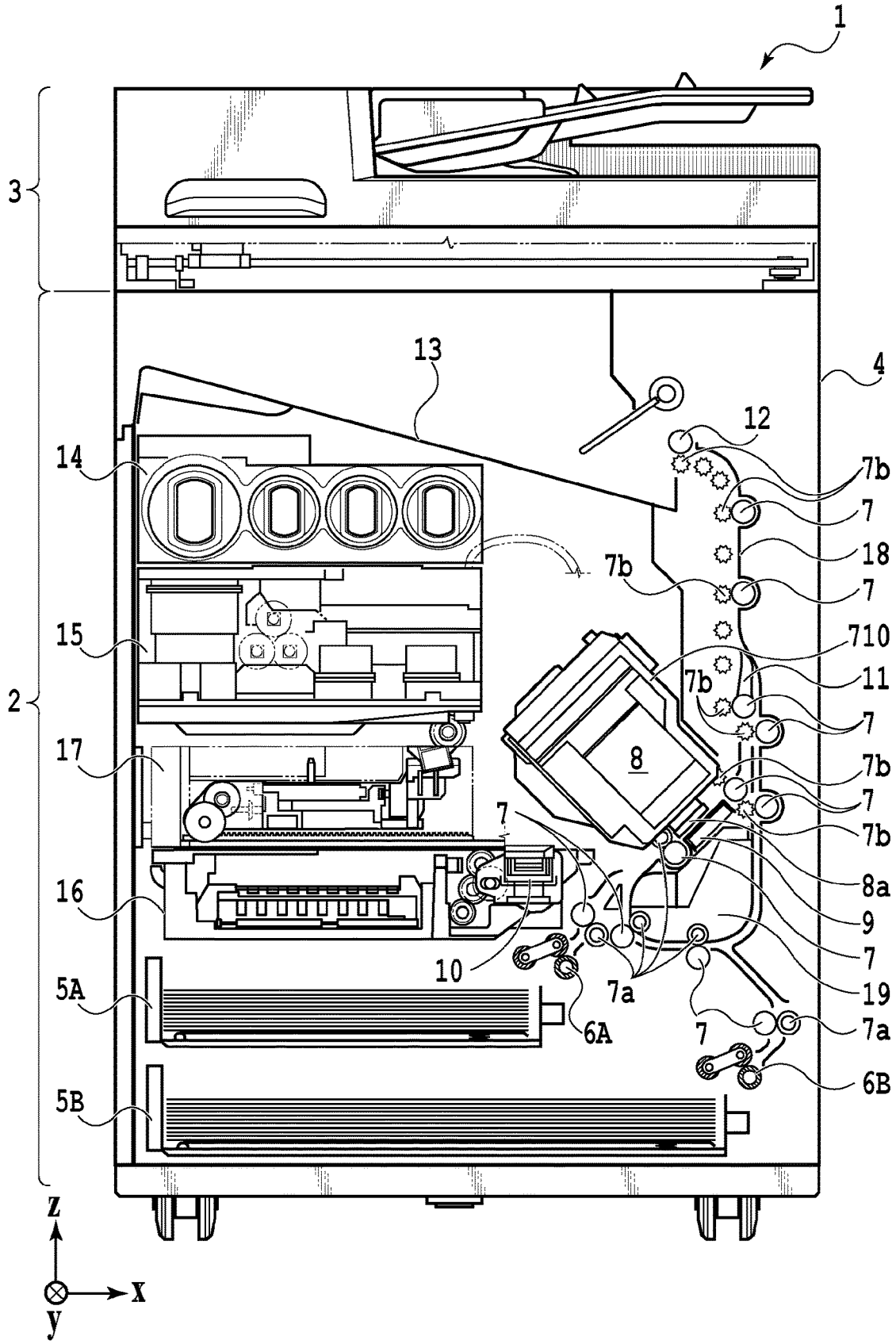
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 4:
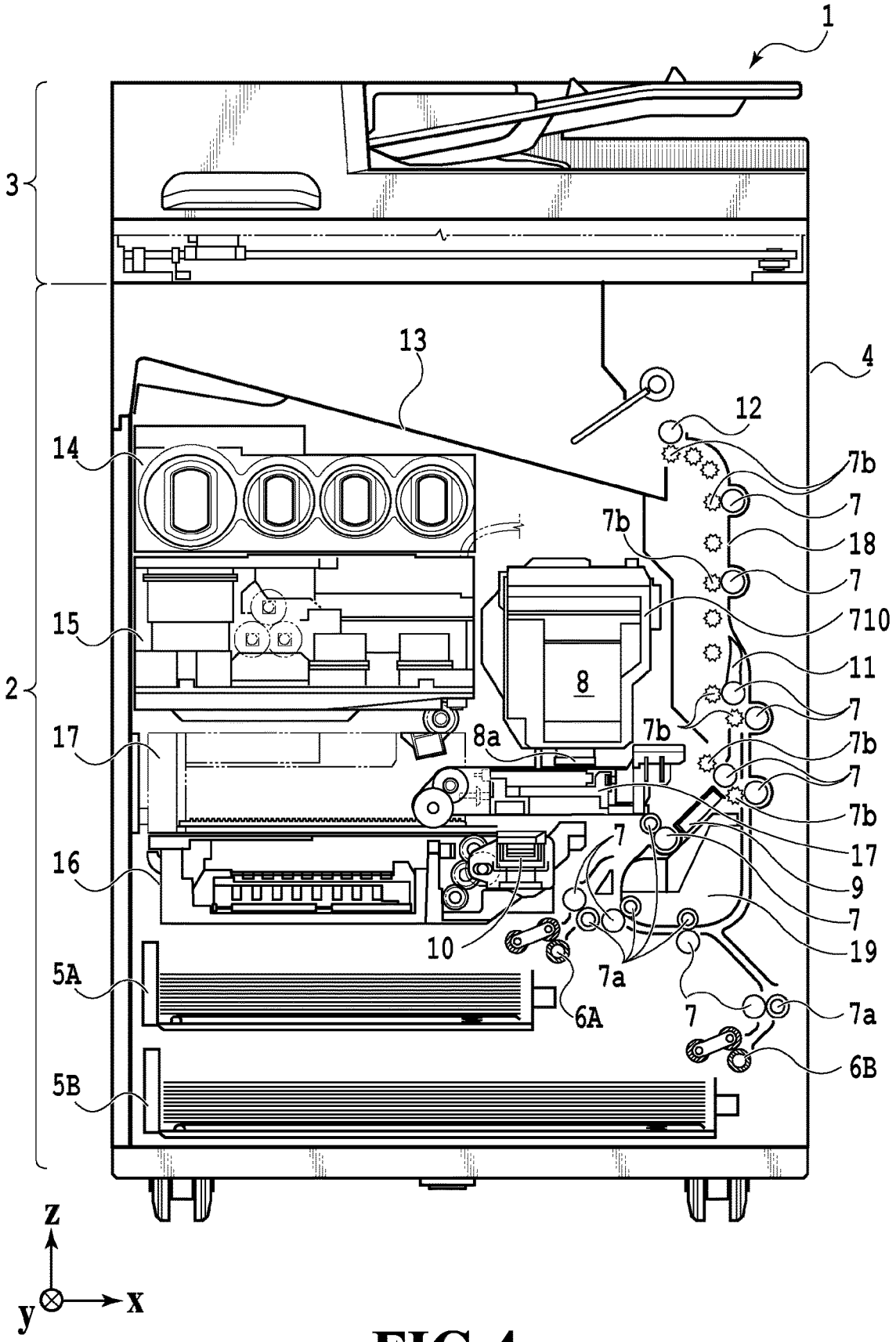
FIG. 4 is a diagram showing the printing apparatus in a maintenance state.

FIG. 4 is a diagram showing the printing apparatus 1 in a maintenance state. In the case of moving the print head 8 from the standby position shown in FIG. 1 to a maintenance position shown in FIG. 4, the print controller 202 moves the print head 8 vertically upward and moves the cap unit 10 vertically downward. The print controller 202 then moves the wiping unit 17 from the evacuation position to the right in FIG. 4. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 4, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

Figure 5A:
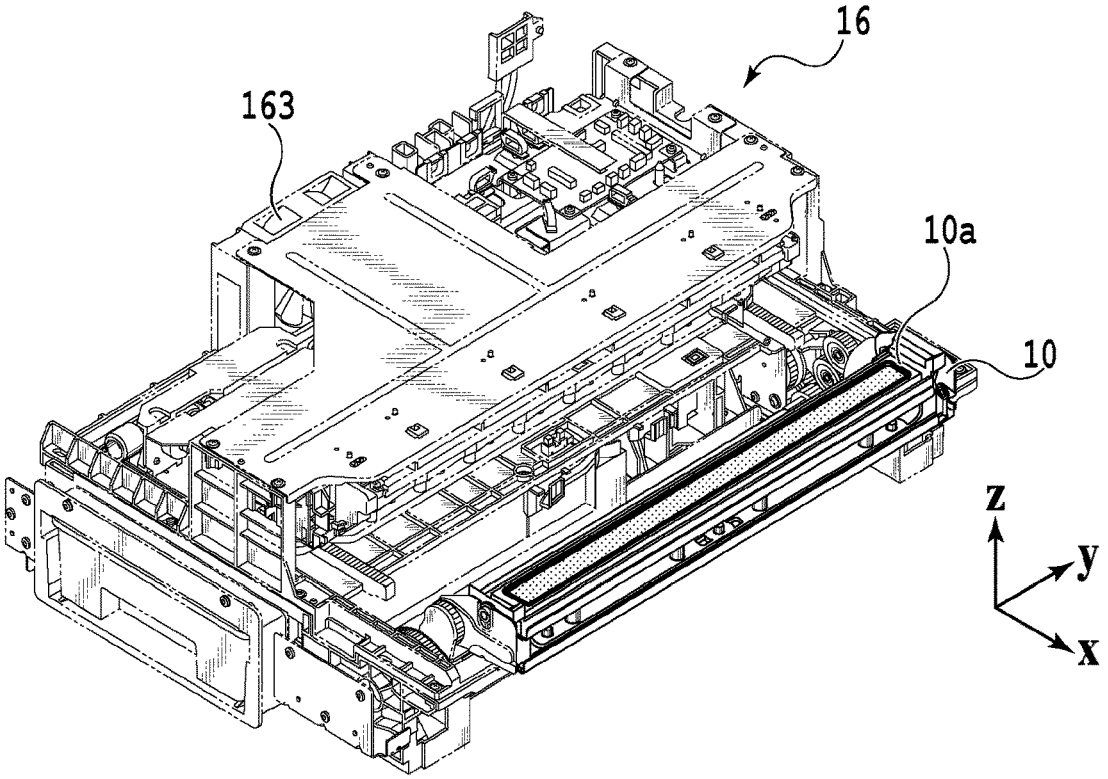
FIGS. 5A and 5B are perspective views showing the configuration of a maintenance unit.
Figure 5B:
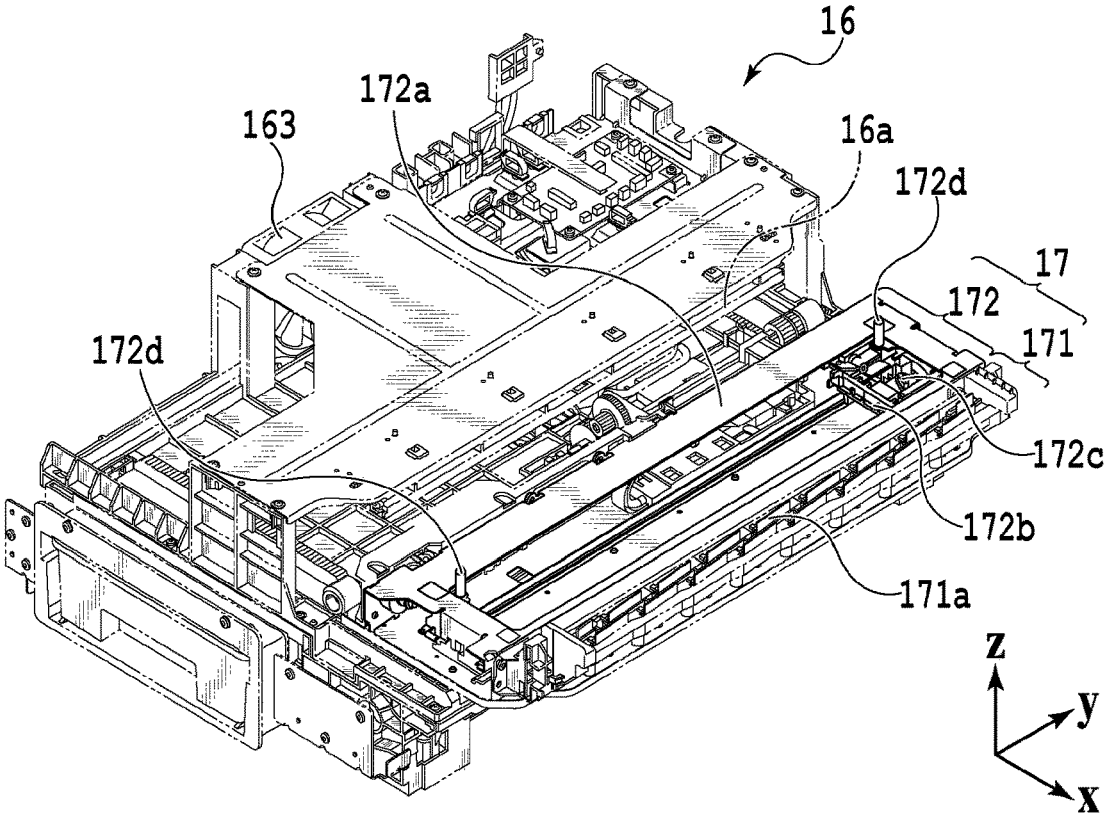

FIG. 5A is a perspective view showing the maintenance unit 16 in a standby position. FIG. 5B is a perspective view showing the maintenance unit 16 in a maintenance position. FIG. 5A corresponds to FIG. 1 and FIG. 5B corresponds to FIG. 4. When the print head 8 is in the standby position, the maintenance unit 16 is in the standby position shown in FIG. 5A, the cap unit 10 has been moved vertically upward, and the wiping unit 17 is housed in the maintenance unit 16. The cap unit 10 comprises a box-shaped cap member 10*a* extending in the y-direction. The cap member 10*a* can be brought into intimate contact with the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink.

On the other hand, in the maintenance position shown in FIG. 5B, the cap unit 10 has been moved vertically downward and the wiping unit 17 has been drawn from the maintenance unit 16. The wiping unit 17 comprises two wiper units: a blade wiper unit 171 and a vacuum wiper unit 172.

In the blade wiper unit 171, blade wipers 171*a* for wiping the ejection opening surface 8*a* in the x-direction are provided in the y-direction by the length of an area where the ejection openings are arrayed. In the case of performing wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink and the like adhering to the ejection opening surface 8*a*.

The entrance of the maintenance unit 16 through which the blade wipers 171*a* are housed is equipped with a wet wiper cleaner 16*a* for removing ink adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction, a carriage 172*b* movable in the y-direction within the opening, and a vacuum wiper 172*c* mounted on the carriage 172*b*. The vacuum wiper 172*c* is provided to wipe the ejection opening surface 8*a* in the y-direction along with the movement of the carriage 172*b*. The tip of the vacuum wiper 172*c* has a suction opening connected to the suction pump (not shown). Accordingly, if the carriage 172*b* is moved in the y-direction while operating the suction pump, ink and the like adhering to the ejection opening surface 8*a* of the print head 8 are wiped and gathered by the vacuum wiper 172*c* and sucked into the suction opening. At this time, the flat plate 172*a* and a dowel pin 172*d* provided at both ends of the opening are used to align the ejection opening surface 8*a* with the vacuum wiper 172*c*.

Figure 6:
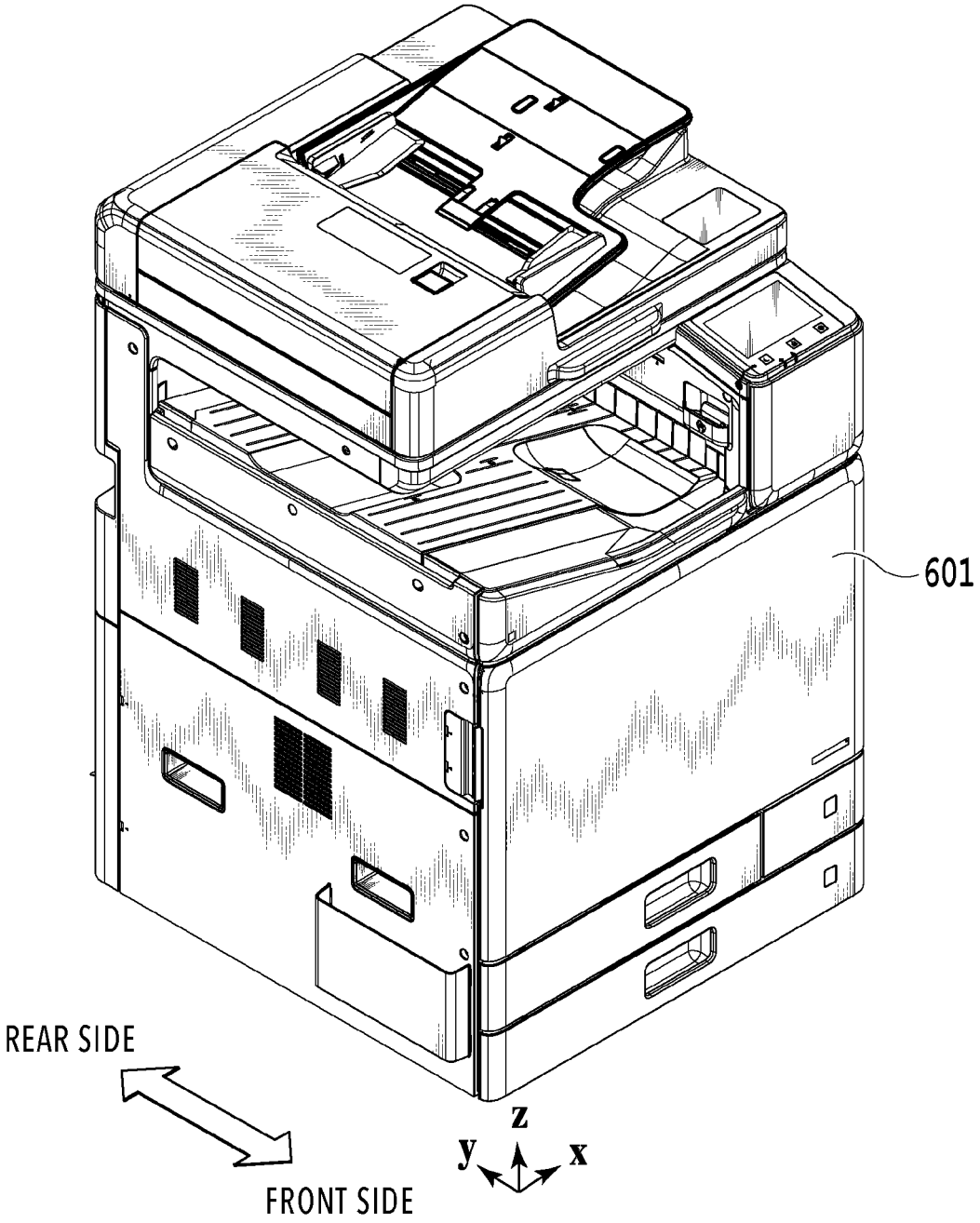
FIG. 6 is an overall perspective view of the printing apparatus.

FIG. 6 is an overall perspective view showing the outer appearance of the printing apparatus 1. By using FIG. 1 and FIG. 6, the outer appearance of the printing apparatus 1 is explained. The side facing forward (side facing in the −y-direction) in FIG. 1 is called the front side and the side facing backward (side facing in the y-direction) in FIG. 1 is called the rear side. On the front side, a front door 601 is provided and it is possible for a user to open and close the front door 601. By a user opening and closing the front door 601, it is made possible to remove a part of the members of the printing apparatus 1.

Figure 7:
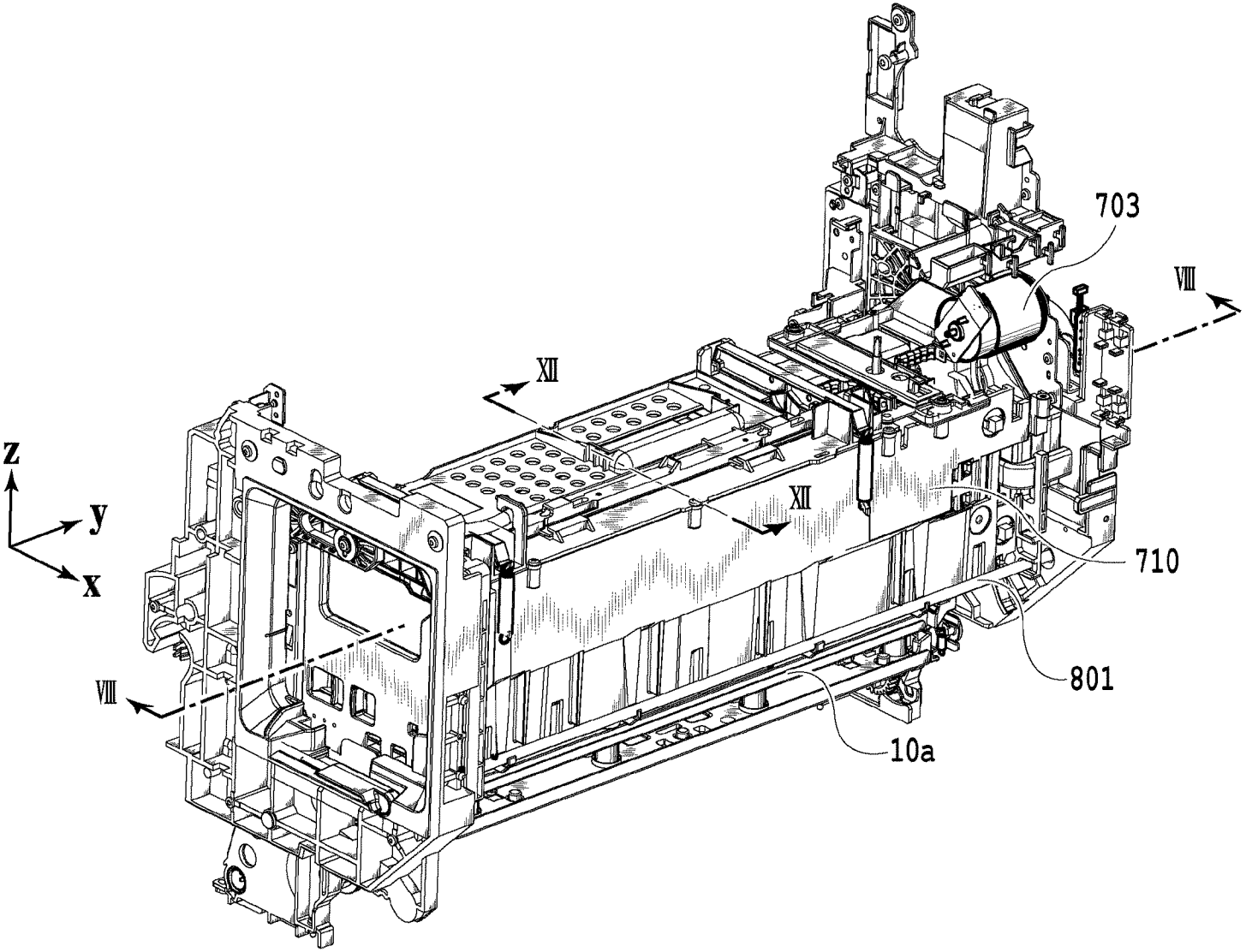
FIG. 7 is a perspective view of a holder member.

FIG. 7 is a perspective view showing the outer appearance of a holder member 710 that houses the print head 8. The print head 8 is held by the holder member 710. At the time of moving the print head 8, a drive motor 703 as a driving unit is driven via the head carriage control unit 208 and the holder member 710 is moved. The print head 8 is housed in the holder member 710, and therefore, it is possible to move the print head 8 by moving the holder member 710.

Figure 8:
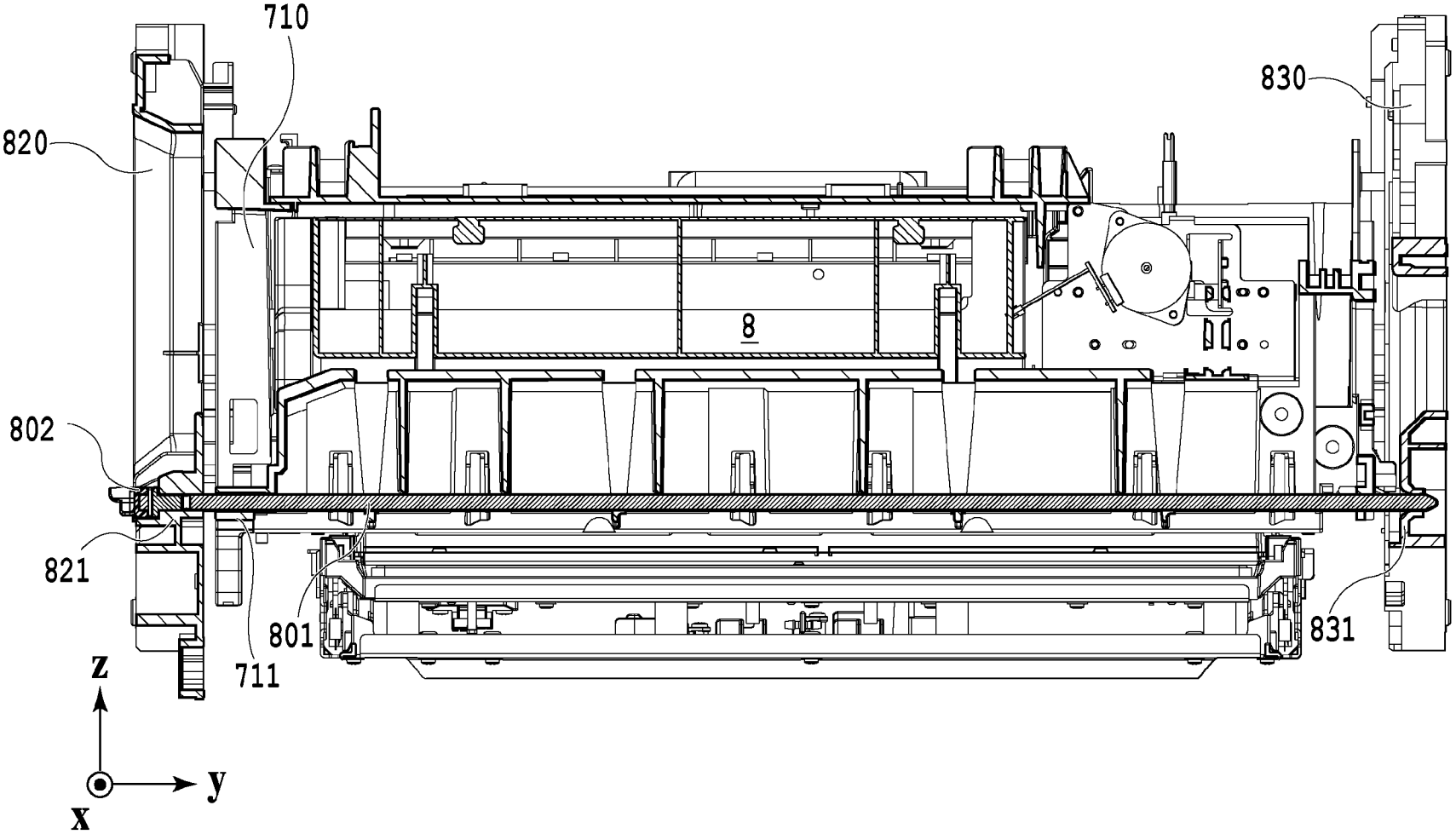
FIG. 8 is a sectional view of the holder member.

FIG. 8 shows a cross section VIII-VIII of FIG. 7. A fixing member 801 is a rod-shaped component for fixing the holder member 710 and is a component attached to the holder member 710 in order to prevent misalignment of the print head 8 due to an impact of transport. It is possible to insert the fixing member 801 into the printing apparatus 1 in a case where the print head 8 is in a standby position shown in FIG. 1. The holder member 710 is provided with an insertion hole 711 into which the fixing member 801 can be inserted. Further, a chassis 820 attached to the casing 4 on the front side of the printing apparatus 1 is also provided with an insertion hole 821 into which the fixing member 801 can be inserted. One end portion of the fixing member 801 is inserted into the insertion hole 821 of the chassis 820 and after being inserted into the insertion hole 711 of the holder member 710, is accommodated in a retaining hole 831 of a chassis 830 attached to the casing 4 on the rear side.

On the other end portion of the fixing member 801, a fastener 802 is provided. By a user bringing the fastener 802 into a locked state, the movement in the x-direction, the y-direction, and the z-direction of the fixing member 801 is regulated. The fixing member 801 is inserted into the insertion hole 711 of the holder member 710, and therefore, the movement in the x-direction and the z-direction of the holder member 710 is regulated within the range of a gap produced between the fixing member 801 and the insertion hole. By attaching the fixing member 801, the movement of the holder member 710 is regulated, and therefore, the movement of the print head 8 is also regulated. Because of this, by attaching the fixing member 801, it is made possible to fix the holder member and it is possible to prevent an impact to the print head 8, a load on a chain of drives, and a deviation of the print head 8 mainly at the time of transport.

The aspect of the fixing member for fixing the holder member 710 is not limited to the above-described aspect. For example, an aspect may also be accepted in which the holder member 710 is fixed by using two or more members. Alternatively, an aspect may also be accepted in which the holder member 710 has a member being capable of fixing the holder member 710 and the holder member 710 is brought into a fixed state by using the member.

Further, in the present embodiment, the fastener 802 is a lever member and a state where the lever member is tilted toward the upstream in the x-direction (backside of the paper surface in FIG. 8) is the locked state and the lock is cancelled by turning the lever member in the clockwise direction from the locked state.

It is possible for a user to attach the fixing member 801 and remove the fixing member 801 by opening the front door 601 under instructions from the printing apparatus 1, which are displayed on the operation panel 104. The fixing member 801 is attached to the holder member 710 at the time of initial installation of the printing apparatus 1. The initial installation refers to the first installation of the shipped printing apparatus 1 at a place where a user makes use of the printing apparatus 1. In a stage where the printing apparatus 1 is set to the initial installation state, as will be described later, the printing apparatus 1 gives a user an instruction to remove the fixing member 801 via the operation panel 104. The user opens the front door 601, cancels the locked state of the fastener 802 of the fixing member 801, and removes the fixing member 801 in such a manner that the fixing member 801 is pulled out toward the front side (−y-direction) in FIG. 1 from the other end portion of the fixing member 801.

Further, there is a case where the printing apparatus 1 in operation is transported (referred to as "secondary transport") from the current place where the printing apparatus 1 is in operation to another place for repair, relocation, or the like. In a stage of preparation for the secondary transport, the printing apparatus 1 gives a notification to prompt a user to attach the fixing member 801 via the operation panel 104. The fixing member 801 is attached again to the holder member 710 by the user.

Here, the notification to a user may also be, for example, an aspect in which a message is displayed on the operation panel 104 of the printing apparatus 1 via the controller unit 100, or an aspect in which a message is displayed on a screen of the host apparatus 400.

The ROM 203 has a storage unit (not shown schematically) configured to store various "flags" indicating specific setting states of the printing apparatus 1. The storage unit stores whether each flag is in the ON state or the OFF state. The print controller 202 acquires whether each flag is in the ON state or the OFF state from the storage unit and issues a command to perform processing in accordance with the state of each flag. The flags of the present embodiment include an "installation flag", a "fixing member attachment flag", and a "reinstallation flag". In the following, each flag is explained.

The "installation flag" indicates whether or not the printing apparatus 1 is in the initial installation state and the initial value is stored as ON. In a case where the "installation flag" is ON, this indicates that the printing apparatus 1 is in the initial installation state. In a case where the setting processing of the initial installation of the printing apparatus 1 is performed once, the "installation flag" is stored in the OFF state.

The "fixing member attachment flag" indicates whether the fixing member 801 is attached to the holder member 710 and the initial value is stored as ON. In a case where the "fixing member attachment flag" is ON, this indicates that the fixing member 801 is attached.

The "reinstallation flag" indicates whether or not the printing apparatus 1 is in the stage of being transported and the initial value is stored as OFF. In a case where the "reinstallation flag" is ON, this indicates that the printing apparatus 1 is in the state of being transported. In the stage of preparation for the second transport, to be described later, the flag is changed form the OFF state into the ON state and stored. The role of each flag will be described later together with explanation of a flowchart.

Figure 9:
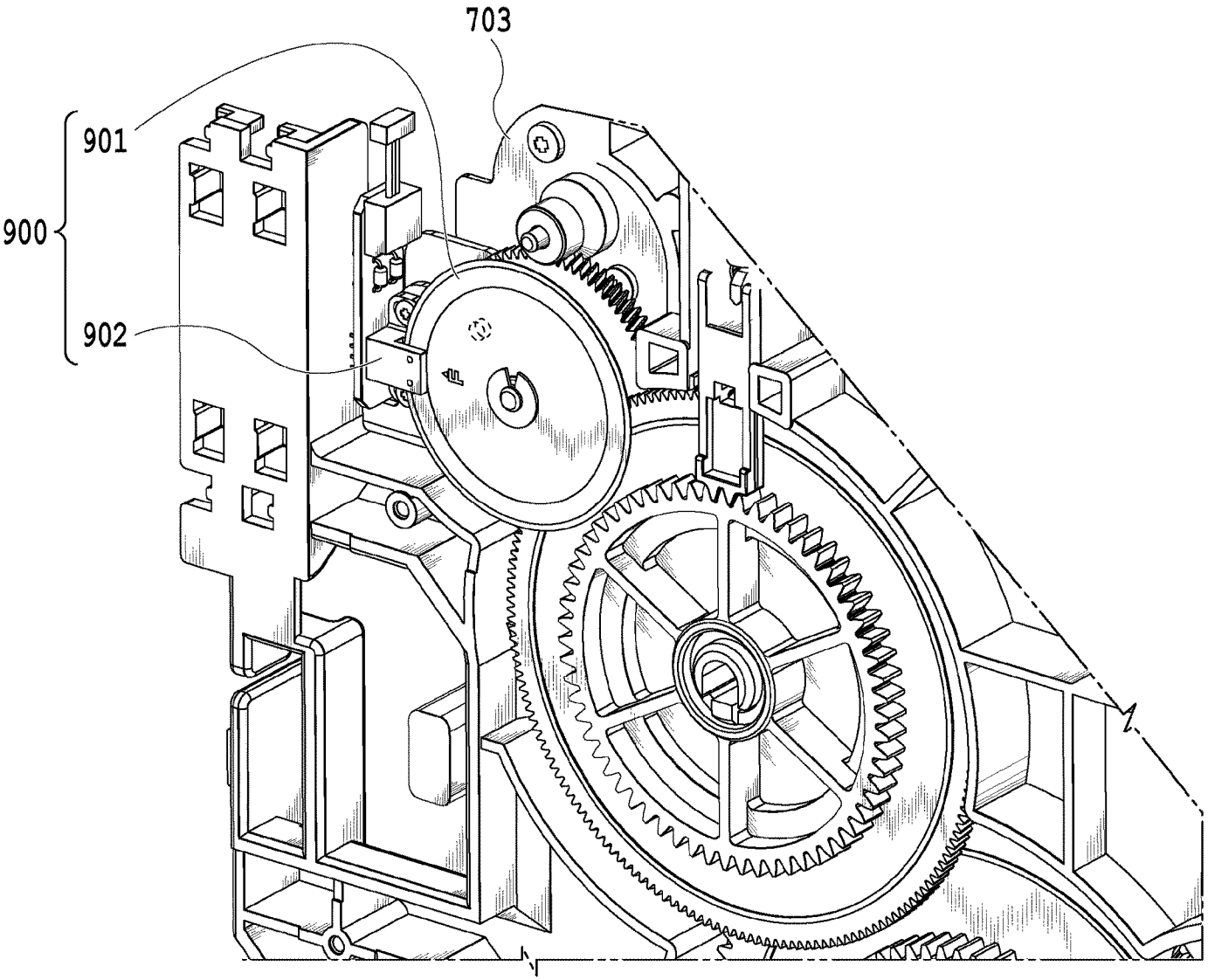
FIG. 9 is a perspective view showing the configuration of a detecting unit.

FIG. 9 is a diagram showing a detecting unit configured to grasp a moving distance of the holder member 710. In the present embodiment, as the detecting unit, an encoder 900 is used. To the drive motor 703 that moves the holder member 710, a code wheel 901 is attached. The code wheel 901 is a disc on which marks are attached at regular intervals in the rotation direction of the drive motor 703. An encoder sensor 902 is arranged so as to be capable of reading the mark of the code wheel 901. By the encoder sensor 902 counting the number of marks having passed of the code wheel 901, the rotation amount of the drive motor 703 is acquired. The rotation amount of the drive motor 703 and the moving distance of the holder member 710 correspond to each other, and therefore, it is possible to acquire the moving distance of the holder member 710 by acquiring the rotation amount of the drive motor 703.

[Determination Processing of Presence/Absence of Fixing Member at the Time of Initial Installation]

Figure 10:
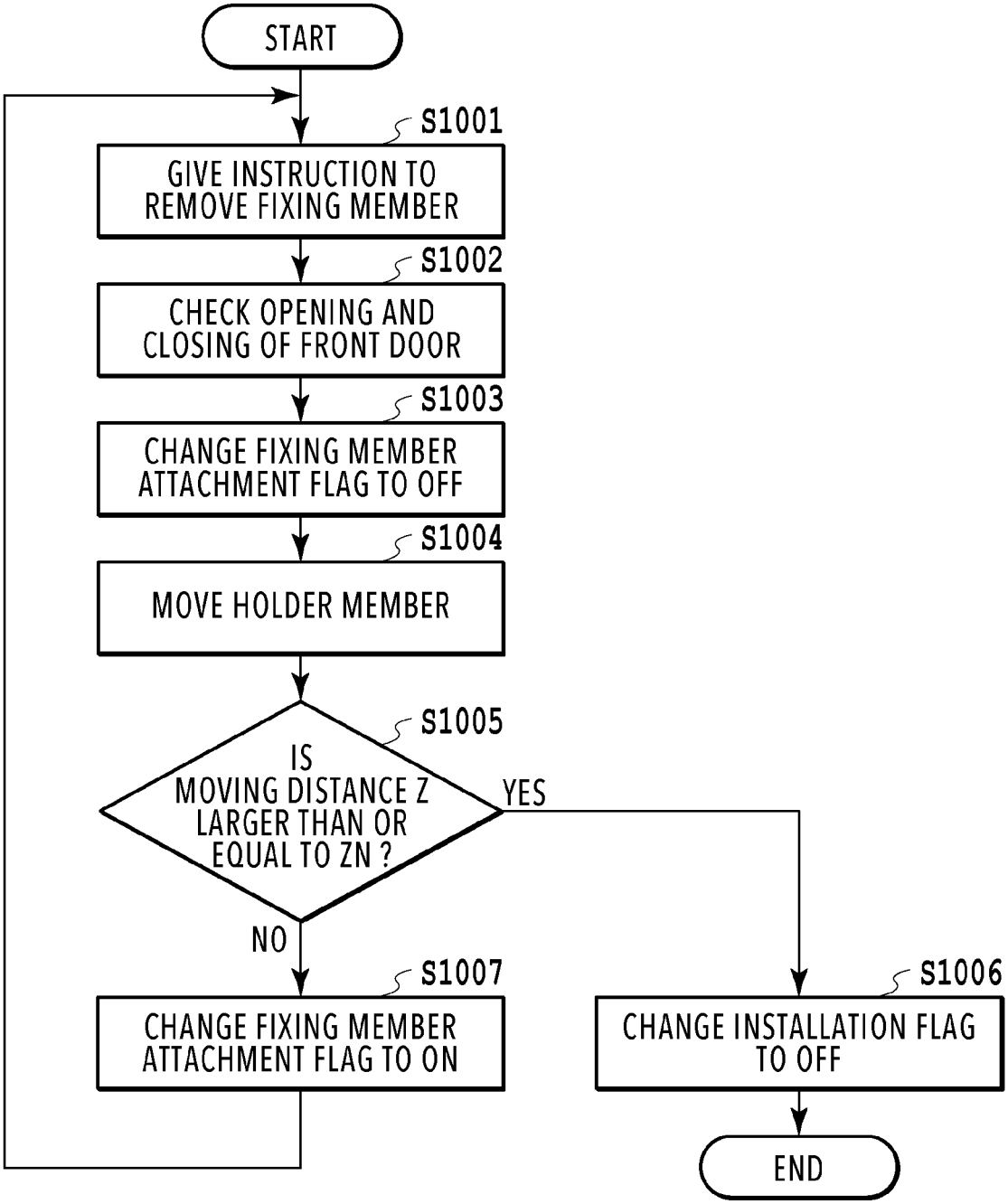
FIG. 10 is a flowchart showing processing of determination at the time of initial installation.

From the above configuration, processing to perform determination of whether the fixing member 801 that fixes the holder member 710 is removed at the time of the initial installation of the printing apparatus 1 is explained by using a flowchart in FIG. 10. Symbol "S" in explanation of each piece of processing means the processing is a step in the flowchart. This flowchart is started from the initial installation state, and therefore, the flowchart is started in the state where each of the "installation flag" and the "fixing member attachment flag" is in the ON state.

In a case where a user turns on the main electric power source of the printing apparatus 1 in the initial installation state, at S1001, the print controller 202 cancels the lock of the front door 601 by a motor (not shown schematically). Next, the print controller 202 gives a notification to prompt a user to open the front door 601 and remove the fixing member 801 via the main controller 101.

At S1002, the print controller 202 checks that the front door 601 is opened and then the front door 601 is closed by a user and brings the front door 601 into the locked state. That is, the print controller 202 detects opening/closing of the front door but does not detect insertion/removal of the fixing member 801. Because of this, in a case where a user simply opens the front door 601 and then closes the front door 601, it is possible to complete the processing at S1002 even in a case where a user does not remove the fixing member 801.

At S1003, the print controller 202 changes the "fixing member attachment flag" from the ON state into the OFF state. As a result of this, the storage unit stores the "fixing member attachment flag" in the OFF state.

At S1004, the print controller 202 moves the holder member 710 by setting the output of the drive motor 703 for moving the holder member 710 to a predetermined output via the head carriage control unit 208. The movement of the holder member 710 at S1004 is performed for checking whether the fixing member 801 is removed. That is, the print controller 202 detects whether insertion/removal of the fixing member 801 is performed without providing a dedicated sensor. Consequently, the print controller 202 moves the holder member 710 in order to perform determination of whether the fixing member 801 is removed by a user by the moving distance of the holder member 710. At this time, the print controller 202 detects a moving distance Z of the holder member 710 acquired by the encoder 900.

Here, the predetermined output is an output lower than the output of the drive motor 703 at the time of performing normal movement, which moves the holder member 710 in order to move the print head from the standby position to the printing position. For example, the predetermined output is an output that causes the drive motor 703 to operate in a state where the upper value of the torque of the drive motor 703 is limited. Due to this, even in a case where the fixing member 801 is not removed for some reason and the holder member 710 is moved with the fixing member 801 being attached, it is possible to lighten the load imposed on the holder member 710 and the print head 8.

At S1005, the print controller 202 determines whether the moving distance Z of the holder member 710 is more than or equal to a predetermined value. In the present embodiment, a reference moving distance Zn by which the holder member 710 moves normally by the predetermined output in a state where the fixing member 801 is not attached is taken to be the predetermined value. The print controller 202 determines whether or not the moving distance Z of the holder member 710 is more than or equal to the reference moving distance Zn. It is assumed that the reference moving distance Zn is found in advance.

In a case of determining that the moving distance Z of the holder member 710 is larger than the value of Zn at S1005, the print controller 202 determines that the fixing member 801 is removed by a user. Consequently, at S1006, the print controller 202 changes the "installation flag" from the ON state into the OFF state. That is, it is indicated that the holder member 710 has been able to move normally, and therefore, it is concluded that the fixing member 801 is not attached to the holder member 710. Consequently, the "installation flag" indicating the initial installation state is changed from the ON state into the OFF state and the initial setting processing terminates.

In a case of determining that the moving distance Z is less than the value of Zn at S1005, the print controller 202 determines that the fixing member 801 is not removed. Consequently, at S1007, the print controller 202 changes the "fixing member attachment flag" from OFF to ON. Then, the processing returns to S1001 again and the print controller 202 gives a notification to prompt a user to cancel the lock of the front door 601, open the front door 601, and remove the fixing member 801.

An aspect may also be accepted in which the processing to change the "fixing member attachment flag" to OFF performed at S1003 is performed at the same timing as the processing to change the "installation flag" to OFF at S1006. In this case, at S1003, the processing to change the "fixing member attachment flag" to OFF is not performed, and therefore, in the stage of the processing at S1007, the "fixing member attachment flag" is stored unchanged as ON, which is the initial value. Consequently, the processing to change the "fixing member attachment flag" to OFF at S1007 is no longer necessary.

As explained above, according to the present embodiment, in a case where an attempt is made to activate the printing apparatus 1 in the state where the holder member 710 is fixed by the fixing member 801, the printing apparatus 1 prompts a user to remove the fixing member 801. That is, in a case where the fixing member 801 is attached, the holder member 710 is moved by the predetermined output of the drive motor 703 and determination of whether the fixing member 801 is attached is performed. This determination is repeated until the fixing member 801 is removed by a user. Due to this, it is possible to prevent the normal operation, such as the operation to move the print head 8 from the standby position to the printing position, from being performed in a state where the holder member 710 is fixed by the fixing member 801, and therefore, it is possible to prevent the printing apparatus 1 itself from being damaged.

Further, the determination of whether the fixing member 801 is attached to the holder member 710 is performed based on the moving distance Z of the holder member. Consequently, it is possible for the print controller 202 to determine whether the fixing member 801 is attached to the holder member 710 without providing a special sensor for detecting attachment of the fixing member 801 to the printing apparatus 1.

Modification Example

There is a case where a small moving distance Zh by which the holder member 710 can move even though the fixing member 801 is attached to the holder member 710 is made clear in advance. That is, the moving distance Zh is a value smaller than the reference moving distance Zn by which the holder member 710 normally moves by the predetermined output. In such a case, an aspect may also be accepted in which the print controller 202 determines whether the fixing member 801 is attached at S1005 based on the moving distance Zh by which the holder member 710 can move even through the fixing member 801 is attached. For example, an aspect may also be accepted in which the print controller 202 determines that the fixing member 801 is not attached to the holder member 710 in a case where the moving distance Z of the holder member 710 is larger than Zh. And on a condition that the moving distance Z of the holder member 710 is less than or equal to Zh, the print controller 202 determines that the fixing member 801 is attached to the holder member 710.

Second Embodiment

The present embodiment is an aspect in which determination of whether the fixing member 801 is attached by a user is performed in a state of preparation for secondary transport of the printing apparatus 1. At the time of transporting the printing apparatus 1, it is desirable for the fixing member 801 to be attached to the holder member 710. Consequently, according to the present embodiment, the printing apparatus 1 gives a notification to prompt a user to attach the fixing member 801 before performing secondary transport. In the present embodiment, differences from the first embodiment are explained mainly. The portions not described explicitly in particular are the same configurations and processing as those of the first embodiment.

Figure 11:
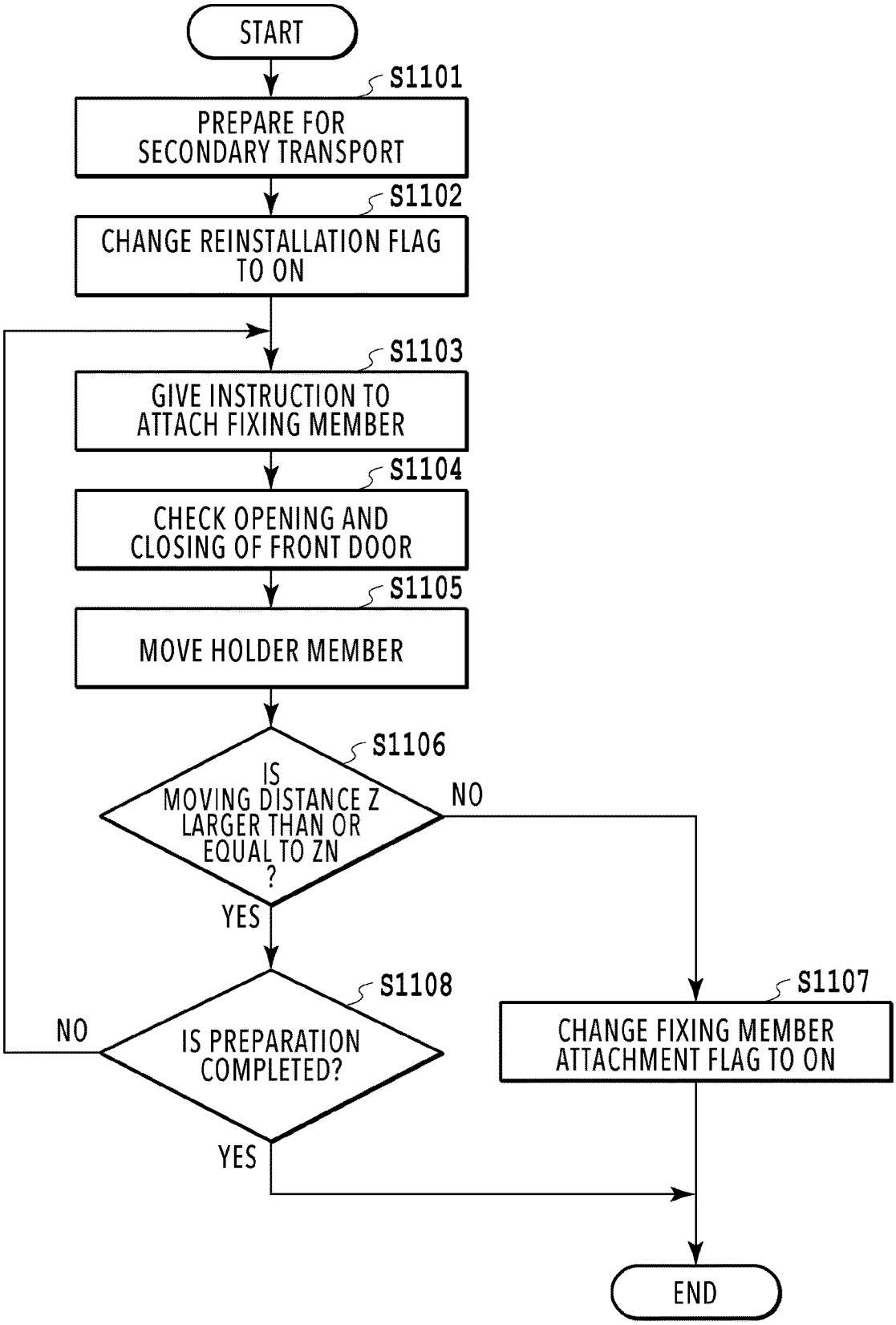
FIG. 11 is a flowchart showing processing of determination at the time of secondary transport.

FIG. 11 is a flowchart showing processing to determine whether the fixing member 801 is attached at the time of preparation for secondary transport of the printing apparatus 1. The initial installation setting of the printing apparatus 1 is terminated, and therefore, it is assumed that the "installation flag" is stored as OFF. Further, it is premised that the removal of the fixing member 801 has been performed normally, and therefore, it is assumed that the "fixing member attachment flag" is stored as OFF. It is assumed that the "reinstallation flag" is stored as OFF and the following processing starts from this state. In a case where a user performs a predetermined operation and performs setting of preparation for transport, the print controller 202 acquires the command and the following processing is started.

At S1101, the print controller 202 issues a command to prepare for transport. For example, a command to discharge the ink in the ink flow path is issued. At S1102, the print controller 202 changes the "reinstallation flag" from OFF to ON. That is, the processing of preparation for secondary transport is completed at S1101, and therefore, at S1102, the "reinstallation flag" is changed to ON and it is indicated that the printing apparatus 1 is in the state of being transported. However, in the present embodiment, the processing to check whether the fixing member 801 is attached is further performed, and therefore, the following processing is performed continuously. An aspect may also be accepted in which the "reinstallation flag" is changed from OFF to ON at the timing the processing of this flowchart terminates.

At S1103, the print controller 202 cancels the lock of the front door 601 by a motor (not shown schematically). Next, the print controller 202 gives a user a notification to prompt the user to open the front door 601 and attach the fixing member 801 via the main controller 101. Similarly, the print controller 202 gives a notification to prompt a user to remove the maintenance cartridge (not shown schematically), which is a waste ink tank storing waste ink collected by the maintenance unit.

At S1104, the print controller 202 checks that the front door is opened and then the front door 601 is closed by a user and brings the front door 601 into the locked state. S1105 and S1106 are the same processing as that at 1004 and 1105 in FIG. 10, and therefore, explanation is omitted.

In a case of determining that the moving distance Z of the holder member 710 is smaller than the value of the reference moving distance Zn by which the holder member 710 moves normally by the predetermined output at S1106, the print controller 202 determines that the fixing member 801 is attached appropriately by a user. Because of this, at S1107, the print controller 202 changes the "fixing member attachment flag" from OFF to ON. Then, the preparation for transport is completed.

In a case of determining that the moving distance Z of the holder member 710 is larger than the value of Zn at S1106, the print controller 202 determines that the fixing member 801 is not attached to the holder member 710. In this case, at S1108, the print controller 202 gives a notification to check with a user whether to complete preparation for transport without attaching the fixing member 801 via the main controller 101. In a case where the user indicates that the user completes preparation for transport via the operation panel 104, the print controller 202 acquires the contents and completes preparation for transport in the state where the fixing member 801 is not attached to the holder member 710. In a case where a user indicates that the user does not complete preparation for transport via the operation panel 104, the processing returns to S1103 and gives a notification to prompt the user to open the front door 601 and attach the fixing member 801.

As explained above, according to the present embodiment, at the time of preparation for secondary transport of the printing apparatus 1, in a case where the fixing member 801 is not attached to the holder member 710, it is possible to prompt a user to attach the fixing member 801 to the holder member 710. Due to this, also at the time of secondary transport, it is possible to transport with the fixing member 801 being attached, and therefor, it is possible to prevent misalignment of the print head 8 due to an impact of transport at the time of secondary transport.

Modification Example

As in the case with the first embodiment, an aspect may also be accepted in which the print controller 202 determines whether the moving distance Z of the holder member 710 is larger than the moving distance Zh by which the holder member 710 can move even though the fixing member 801 is attached at S1106. As will be described later, in a case where the standby state continues for a long time, there is a possibility that the cap member 10*a* and the ink on the ejection opening surface 8*a* solidify and stick to each other. In this case, the moving distance Z of the holder member 710 is a value smaller than the reference moving distance Zn by which the holder member 710 moves normally by the predetermined output. That is, in the stage of preparation for secondary transport, even though the moving distance Z is a value smaller than Zn, there is a case where the fixing member 801 is not attached to the holder member 710. Consequently, the present modification example is an aspect favorable in a point that it is possible to determine whether the fixing member 801 is attached to the holder member 710 by the print controller 202 even in a case where the cap member 10*a* and the ink on the ejection opening surface 8*a* have solidified.

Third Embodiment

The present embodiment is an aspect in which determination of whether the cap member 10*a* and the ejection opening surface 8*a* have solidified and stuck to each other is also performed, in addition to the determination of whether the fixing member 801 is removed at the time of the completion of secondary transport.

Figure 12:
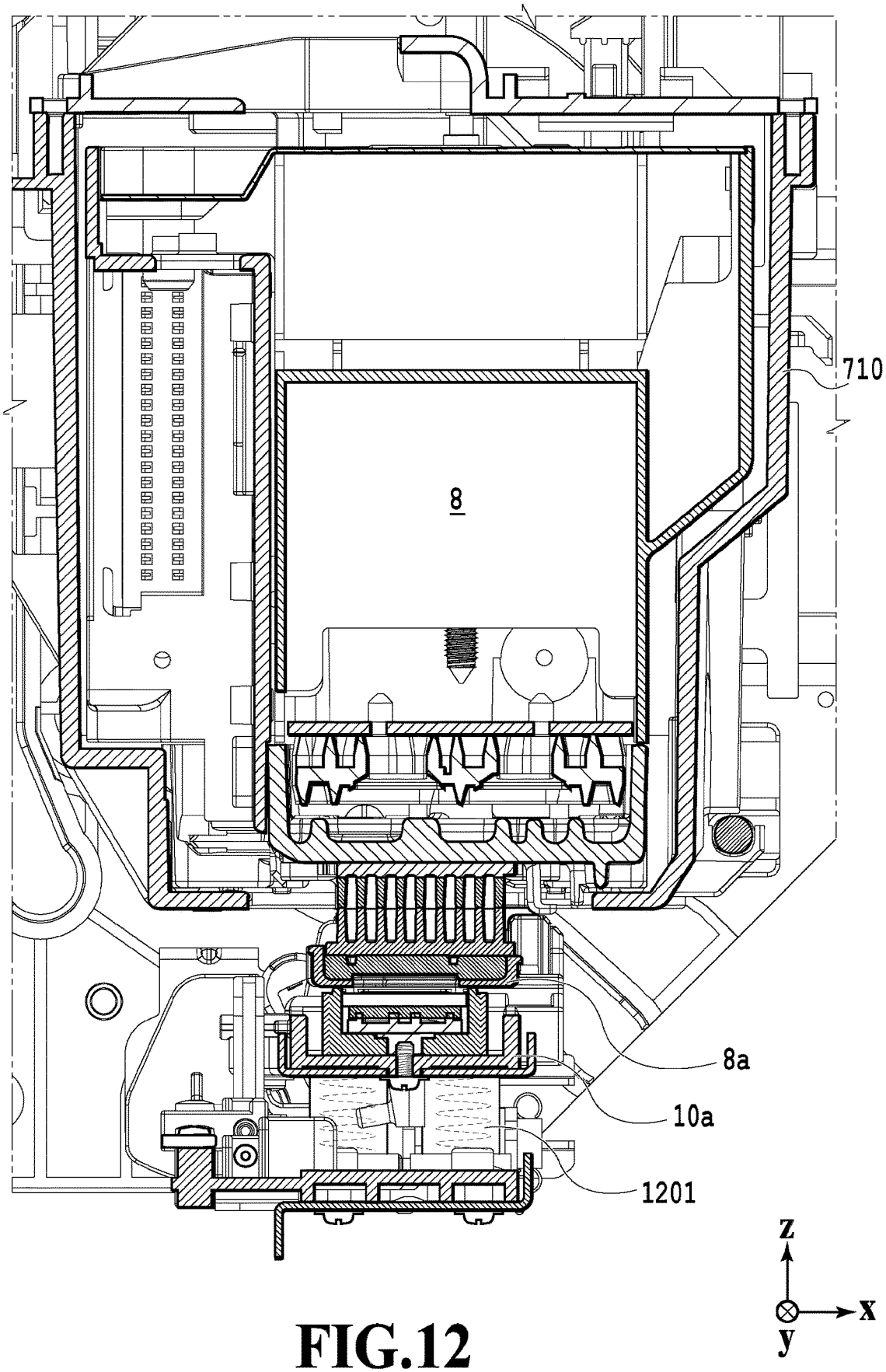
FIG. 12 is a sectional view of a print head and a cap member.

FIG. 12 shows a cross section XII-XII of FIG. 7. FIG. 12 is an enlarged diagram of the section of the print head 8 in the standby state. The cap member 10*a* abuts on the ejection opening surface 8*a* of the print head 8 by a spring force of a cap pressing spring 1201 located under the cap member 10*a* in the vertical direction (in the −Z-direction).

Consequently, the cap member 10*a* is kept in the contact state with the ejection opening surface 8*a* in the standby state of the printing apparatus 1. Because of this, in a case where the standby state continues for a long time, such as the time of transport, the cap member 10*a* and the ink on the ejection opening surface 8*a* solidify, and therefore, there is a possibility that the cap member 10*a* and the ejection opening surface 8*a* stick to each other. Because of this, there is a case where it is not possible to separate the cap member 10*a* and the ejection opening surface 8*a* even though the drive motor 703 performs the normal drive for moving the holder member 710.

Figure 13A:
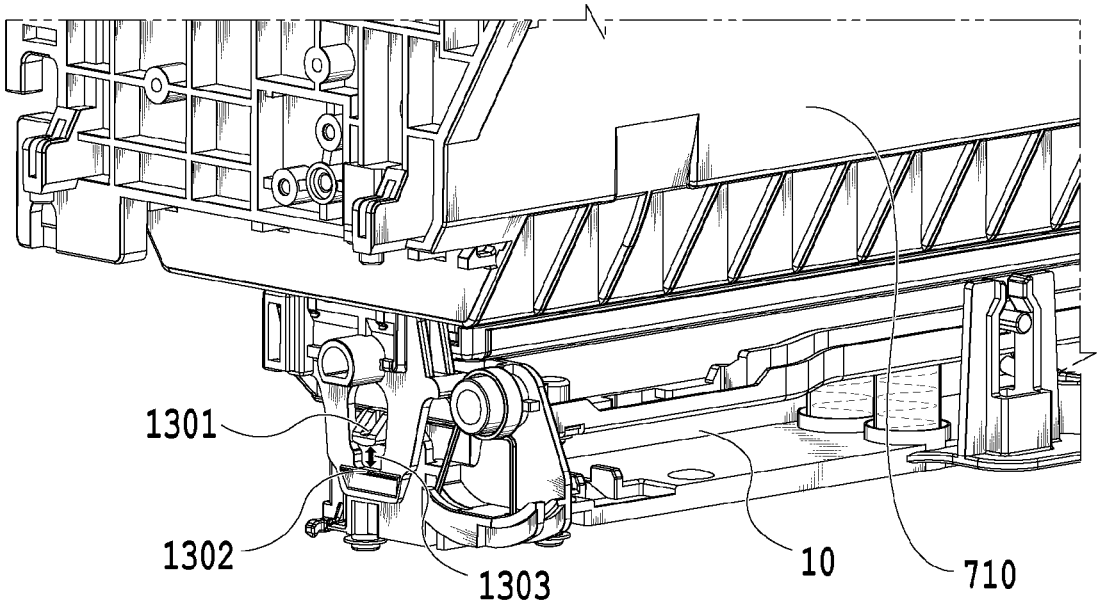
FIGS. 13A and 13B are perspective views showing the configuration of a holder position regulating unit.
Figure 13B:
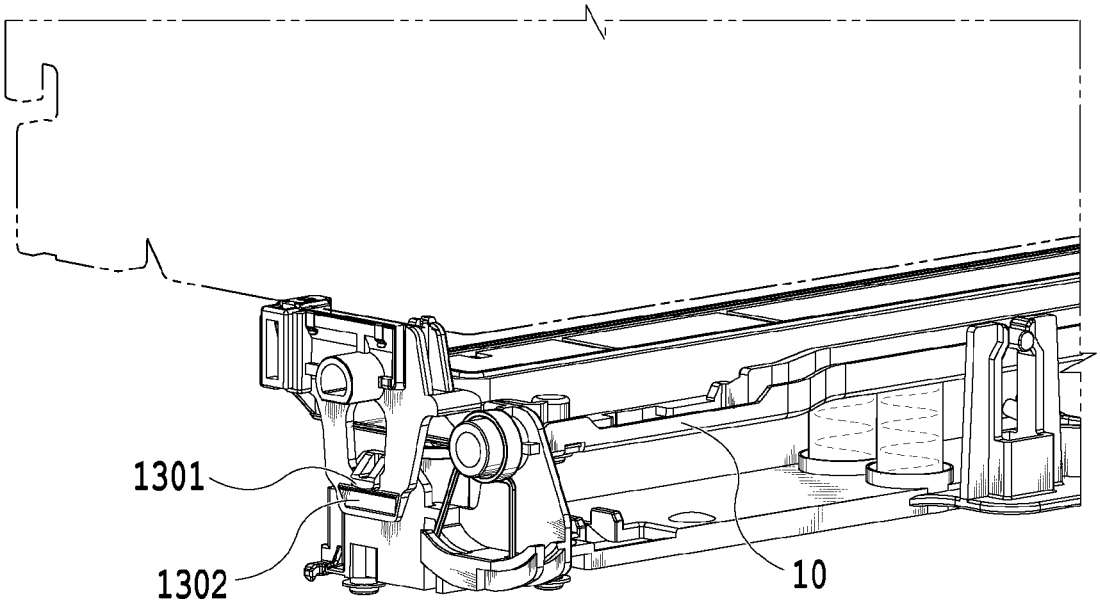

FIGS. 13A and 13B are perspective views of the holder member 710 and the cap unit 10 in the standby state. FIG. 13A is a perspective view of the cap member 10*a* in the state where the cap member 10*a* abuts on the ejection opening surface 8*a* (capping state). FIG. 13B is a perspective view of the cap member 10*a* in a case where the holder member 710 is moved in the state where the cap member 10*a* sticks to the ejection opening surface 8*a*.

The cap unit 10 is provided with a cap position regulating unit 1301 and a retaining portion 1302 configured to retain the cap position regulating unit 1301. Further, the cap member 10*a* is biased upward by a bias means, such as a spring. FIG. 13*b* shows the state where the cap member 10*a* moves upward by biasing. At this time, the cap position regulating unit 1301 is retained by the retaining portion 1302.

On the other hand, in a case where the cap unit 10 is in the capping state, by the holder member 710 positioning itself with the cap member 10*a*, the cap member 10*a* lowers against spring biasing (FIG. 13A). At this time, the cap position regulating unit 1301 and the retaining portion 1302 separate by a distance 1303 indicated by a double-pointed arrow. As described above, the cap member 10*a* is arranged on the cap unit 10 so as to be movable by the distance 1303. Consequently, in a case where the holder member 710 is moved in the state where the cap member 10*a* sticks to the ejection opening surface 8*a*, the holder member 710 also moves by the moving distance (distance 1303) of the cap unit 10. The moving distance of the holder member 710 at this time is taken to be Zc. Here, Zc may be the same value as the distance 1303, but the bending of the component being taken into consideration, in the present embodiment, Zc is set to a value somewhat larger than the distance 1303.

The moving distance Zc is larger than the moving distance Zh (see the modification example of the first embodiment) in a case where the holder member 710 to which the fixing member 801 is attached is moved by the predetermined output explained in the first embodiment. However, the moving distance Zc is smaller than the reference moving distance Zn in a case where the holder member 710 is moved by the predetermined output in the state where the fixing member 801 is not attached and in the state where the cap member 10 and the ejection opening surface 8*a* do not solidify or and do not stick to each other (see the first embodiment). Because of this, the value of each moving distance satisfies a relationship of Zn>Zc>Zh.

The present embodiment is an aspect in which whether the fixing member 801 is removed is determined at the time of the completion of secondary transport by making use of the relationship of Zn>Zc>Zh. Further, the present embodiment is an aspect in which whether the cap member 10*a* and the ejection opening surface 8*a* solidify and stick to each other is also determined in a case where the moving distance Z of the holder member 710 is in a range between a first value (Zh) and a second value (Zn or Zc) at the time of the completion of secondary transport. According to the present embodiment, in a case where the cap member 10*a* sticks although the fixing member 801 is removed, it is possible to cause processing to perform separating operation to be performed. The present embodiment is explained with differences from the first embodiment being taken mainly. The portions not described explicitly in particular are the same configurations and processing as those of the first embodiment.

Figure 14A:
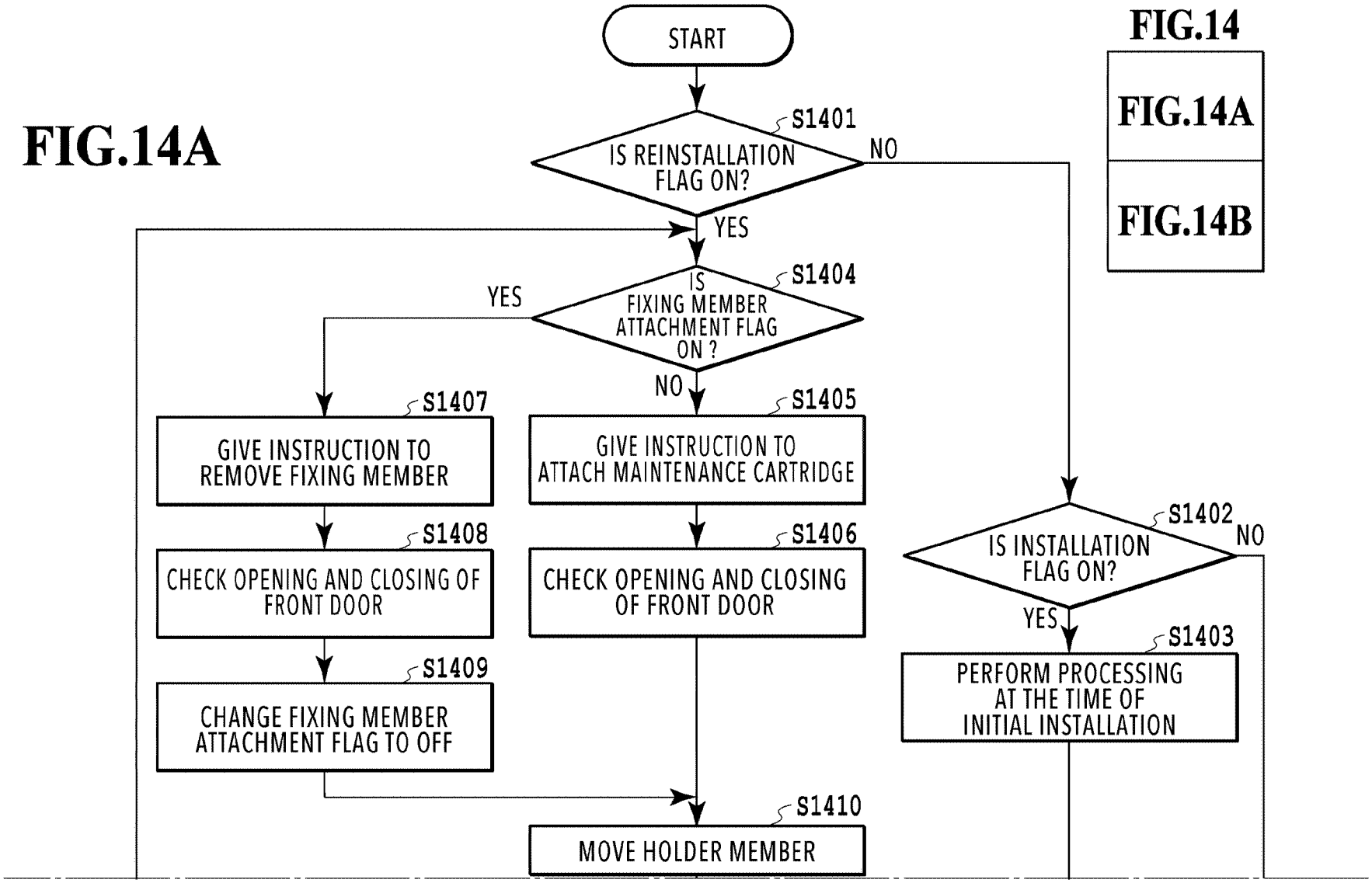
FIG. 14A is a flowchart showing processing of determination after arrival of secondary transport.
Figure 14B:
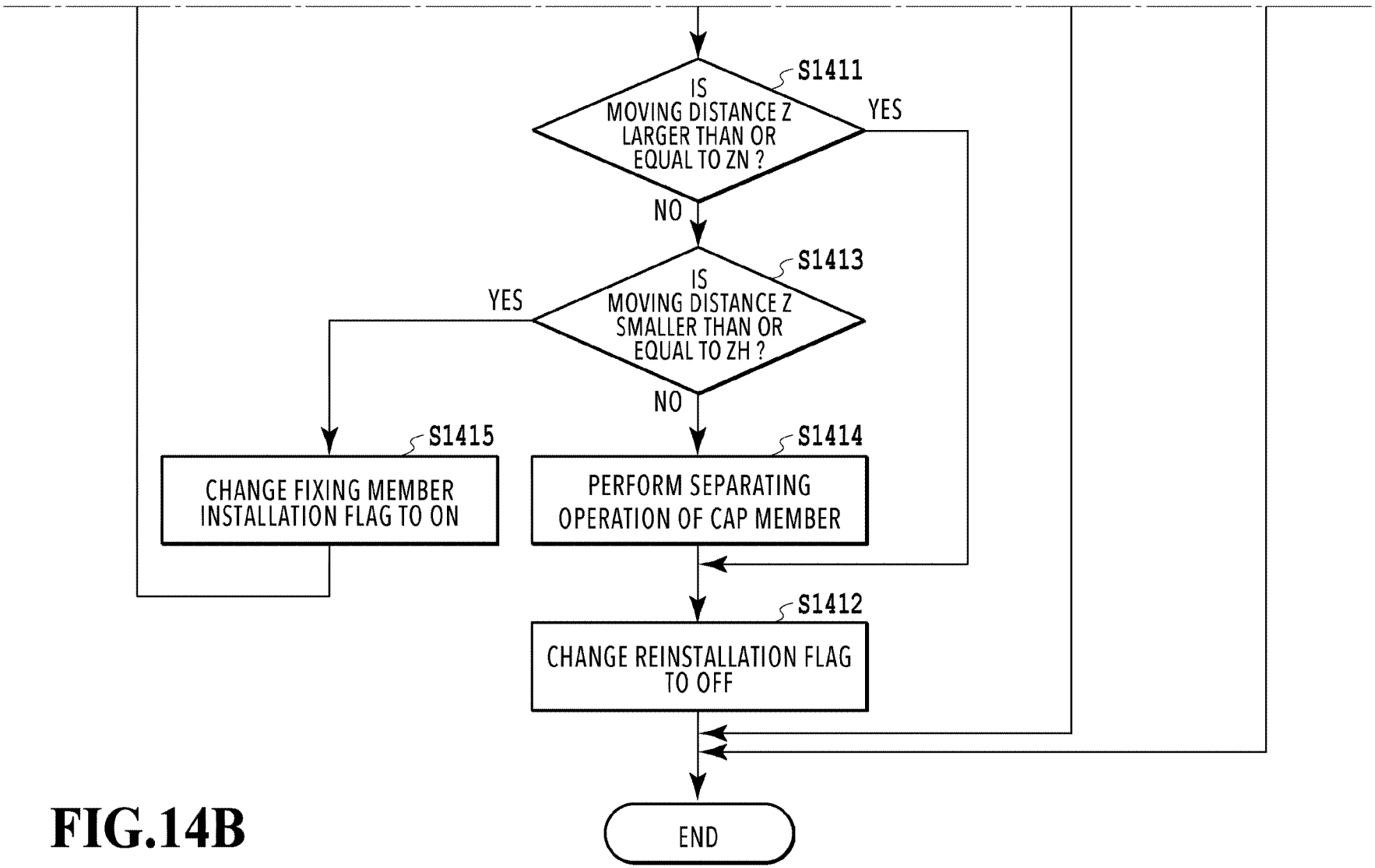
FIG. 14B is a flowchart showing processing of determination after arrival of secondary transport.

FIG. 14 is a flowchart showing processing to perform determination of presence/absence of the fixing member 801 and presence/absence of sticking of the cap member 10*a*. At S1401, the print controller 202 determines whether the "reinstallation flag" is in the ON state. In a case where the "reinstallation flag" is in the OFF state, the processing advances to S1402 and whether the "installation flag" is in the ON state is determined. Here, in a case where the "installation flag" is in the ON state, the state is the initial installation state, and therefore, the processing of the flowchart in FIG. 10 is performed (S1403). In a case where the "installation flag" is in the OFF state, the state is the normal state, and therefore, the processing terminates. At the time of the completion of secondary transport, the reinstallation flag is ON. Because of this, at the time of the completion of secondary transport, the processing advances to the processing at S1404.

At S1404, the print controller 202 determines whether the "fixing member attachment flag" is in the ON state. As described previously, even though the fixing member 801 is not attached to the holder member 710, there is a case where secondary transport of the printing apparatus 1 is performed. Because of this, there may be a case where the "fixing member attachment flag" is in the OFF state at the time of the completion of secondary transport, and therefore, the processing at S1404 is performed. In a case where the "fixing member attachment flag" is in the OFF state, the processing advances to the processing at S1405. At S1405, the print controller 202 cancels the lock of the front door 601. Next, the print controller 202 gives a user a notification to prompt the user to open the front door 601 and attach the maintenance cartridge via the main controller 101. The processing at S1406 is the same as the processing at S1002 in FIG. 10, and therefore, explanation is omitted. On the other hand, in a case where the "fixing member attachment flag" is in the ON state at S1404, the processing advances to the processing at S1407.

At S1407, the print controller 202 cancels the lock of the front door 601. Next, the print controller 202 gives a user a notification to prompt the user to open the front door 601 and remove the fixing member 801 via the main controller 101. Similarly, the print controller 202 gives a notification to prompt a user to attach the maintenance cartridge.

The processing at S1408 is the same as the processing at S1002 in FIG. 10, and therefore, explanation is omitted. At S1409, the print controller 202 changes the "fixing member attachment flag" from the ON state into the OFF state. As in the case with the first embodiment, an aspect may also be accepted in which the processing to change the "fixing member attachment flag" to OFF is performed at the same timing as the processing to change the "reinstallation flag" to OFF at S1412.

In the following processing, in a case where the moving distance Z of the holder member 710 is less than or equal to the first value, the print controller 202 determines that the fixing member 801 is attached. In a case where the detected moving distance is within a range between the first value and the second value larger than the first value, the print controller 202 determines that the cap member 10*a* sticks to the ejection opening surface 8*a*. The print controller 202 performs processing based on the determination. Specifically, in a case where the moving distance Z of the holder member 710 is less than or equal to the value of Zh, the print controller 202 determines that the fixing member 801 is attached as explained in the modification example of the first embodiment. In a case where the moving distance Z of the holder member 710 is within a range between Zh (first value) and Zn (second value), the print controller 202 determines that the cap member 10*a* sticks to the ejection opening surface 8*a*. In a case where the moving distance Z is more than or equal to Zn, the print controller 202 determines that the state is the normal state where the fixing member 801 is removed from the holder member 710 and the cap member 10*a* does not stick to the ejection opening surface 8*a*.

The processing at S1410 and S1411 is the same as the processing at S1004 and S1005 in FIG. 10, and therefore, explanation is omitted. In a case of determining that the moving distance Z of the holder member 710 is more than or equal to the reference moving distance Zn at S1411, the print controller 202 changes the "reinstallation flag" from ON to OFF at S1412. That is, it is meant that it was possible for the holder member 710 to move more than or equal to the reference moving distance Zn. Because of this, the print controller 202 determines that the fixing member 801 is not attached to the holder member 710. Further, the print controller 202 determines that the cap member 10*a* does not stick to the ejection opening surface 8*a*. After this, the ink filling processing is performed and the printing apparatus 1 enters the operating state.

In a case where the print controller 202 determines that the moving distance Z of the holder member 710 is a value smaller than Zn at S1411, the processing advances to S1413. At S1413, the print controller 202 determines whether the moving distance Z of the holder member is less than or equal to Zh.

In a case where the print controller 202 determines that the moving distance Z of the holder member 710 is larger than Zh at S1413, the moving distance Z is within a range between Zh and Zn. Consequently, the print controller 202 determines that the cap member 10*a* sticks to the ejection opening surface 8*a*. Because of this, at S1414, the print controller 202 separates the cap member 10*a* from the ejection opening surface 8*a* by operation different from spacing operation at the time of start of the print operation. For example, the print controller 202 causes the cap member 10*a* to be separated from the ejection opening surface 8*a* by performing control so as to partially deform the cap member 10*a*.

In a case of determining that the moving distance Z of the holder member 710 is less than or equal to Zh at S1413, the print controller 202 determines that the fixing member 801 is not removed. Because of this, at S1415, the print controller 202 changes the "fixing member attachment flag" from OFF to ON. Then, the processing returns to S1407 again and the print controller 202 performs a series of processing to remove the fixing member 801.

In the present embodiment, the print controller 202 determines the state of the holder member 710 from the moving distance Z by determining the moving distance Z twice at S1411 and at S1413. An aspect may also be accepted in which a total of two times of determination at S1411 and at S1413 are performed as one-time determination. That is, an aspect may also be accepted in which the print controller 202 performs determination once of whether the moving distance Z is a value less than or equal to Zh, a value larger than Zh and smaller than Zn, or a value more than or equal to Zn. In this case, on a condition that it is determined that the moving distance Z is a value less than or equal to Zh, the processing advances to the processing at S1415. In a case where it is determined that the moving distance Z is a value larger than Zh and smaller than Zn, the processing advances to the processing at S1414. Further, in a case where it is determined that the moving distance Z is a value more than or equal to Zn, the processing advances to S1412.

As explained above, according to the present embodiment, it is possible for the print controller 202 to determine whether the fixing member 801 is attached to the holder member 710 and further to determine whether the ejection opening surface 8*a* and the cap unit 101 solidify and stick to each other. Furthermore, according to results of the determination, processing in accordance with each state is performed. Consequently, it is possible to prevent the processing to separate the cap member 10*a* from being performed despite that the fixing member 801 is attached to the holder member 710. In particular, in many cases, the inkjet printing apparatus mounts a high-power motor, and therefore, in a case where the separating operation of the cap member 10*a* is performed with the holder member 710 being fixed by the fixing member 801, there is a possibility that the printing apparatus 1 itself is damaged. According to the present embodiment, processing in accordance with results of determination is performed, and therefore, it is possible to prevent the printing apparatus 1 itself from being damaged.

Modification Example

The second value used for the print controller 202 to determine whether the cap member 10*a* and the ejection opening surface 8*a* stick to each other may be taken to be the maxim moving distance Zc of the holder member 710 in the state where the cap member 10*a* and the ejection opening surface 8*a* solidify and stick to each other. That is, an aspect may also be accepted in which the print controller 202 determines whether the moving distance Z of the holder member 710 is a value larger than Zc at S1411 in FIG. 14. In this case, on a condition that the moving distance Z is a value larger than Zc, it is concluded that the cap member 10*a* and the ejection opening surface 8*a* do not solidify and do not stick to each other from the relationship of Zn>Zc>Zh. Because of this, the processing advances to S1412 and the "reinstallation flag" indicating the secondary transport state is changed from the ON state into the OFF state and stored. Further, in a case where the moving distance Z is less than or equal to the value of Zc, from the relationship of Zn>Zc>Zh, the state is at least one of the state where the fixing member 801 is attached to the holder member 710 and the state where the cap member 10*a* and the ejection opening surface 8*a* solidify and stick to each other. Consequently, the processing advances to S1413 and determination of whether the state is the state where the fixing member 801 is attached to the holder member 710 or the state where the cap member 10*a* and the ejection opening surface 8*a* solidify and stick to each other is performed and after this, processing in accordance with the state is performed.

Other Embodiments

In the embodiments described previously, the aspect is such that the print controller 202 performs a series of determination processing, but an aspect may also be accepted in which the main controller 101 performs determination processing.

The third embodiment is the aspect in which the determination of whether the cap member 10*a* and the ejection opening surface 8*a* solidify and stick to each other is performed at the time of the completion of secondary transport, but it may also be possible to perform the determination after the capping state continues for a long time. For example, at the time of the electric power source being turned on, the state where the ejection opening surface 8*a* and the cap member 10*a* contact each other continues for a long time, and therefore, the possibility is strong that the cap member 10*a* and the ejection opening surface 8*a* solidify and stick to each other. Consequently, an aspect may also be accepted in which the processing in FIG. 14 is performed at the time of the electric power source being turned on.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-151632, filed Aug. 10, 2018, which is hereby incorporated by reference wherein in its entirety.

What is claimed is:

1. A printing apparatus comprising:

a print head having an ejection opening surface on which an ejection opening configured to eject ink is formed;

a holder member that holds the print head;

a moving unit configured to move the holder member;

a fixing member that fixes the holder member;

a detecting unit configured to detect a moving distance of the holder member; and a first determining part configured to determine that the holder member is fixed by the fixing member in a case where the moving distance detected by the detecting unit is less than a predetermined value.

2. The printing apparatus according to claim 1, wherein the predetermined value is a value of a moving distance by which the holder member moves in a case where the moving unit performs to move the holder member by a predetermined output in a state where the holder member is not fixed by the fixing member.

3. The printing apparatus according to claim 1, wherein the predetermined value is a first value based on a moving distance by which the holder member can move in a state where the holder member is fixed by the fixing member.

4. The printing apparatus according to claim 3, further comprising:

a cap member that covers the ejection opening surface; and a second determining part configured to determine that the cap member sticks to the ejection opening surface in a case where a moving distance of the holder member is larger than the first value and less than a second value larger than the first value.

5. The printing apparatus according to claim 4, wherein the second value is a value based on a moving distance by which the holder member moves in a case where the moving unit performs to move the holder member by a predetermined output in a state where the holder member is not fixed by the fixing member and in a state where the cap member covers the ejection opening surface but does not stick to the ejection opening surface.

6. The printing apparatus according to claim 4, wherein the second value is a value based on a moving distance by which the holder member can move in a state where the cap member sticks to the ejection opening surface.

7. The printing apparatus according to claim 4, wherein the cap member is capable of performing spacing operation to move from a capping position at which the cap member covers the ejection opening surface to an evacuate position at which the cap member does not abut on the ejection opening surface and in a case where the second determining part determines that the cap member sticks to the ejection opening surface, separating operation of the cap member different from the spacing operation is performed.

8. The printing apparatus according to claim 1, further comprising:

a storing unit configured to store whether the printing apparatus is in an initial installation state or in a state of being transported, wherein in a case where a state stored in the storing unit is an initial installation state or a state of being transported, on a condition that it is determined that the holder member is fixed by the fixing member, a first notification is given to a user.

9. The printing apparatus according to claim 8, wherein in a case where the printing apparatus is performing preparation for transport, on a condition that it is not determined that the holder member is fixed by the fixing member, a second notification different from the first notification is given to a user.

10. The printing apparatus according to claim 1, wherein the print head is provided with a plurality of ejection openings in an area corresponding to a width of a print medium.

11. A printing apparatus comprising:

a print head having an ejection opening surface on which an ejection opening configured to eject ink is formed;

a holder member that holds the print head;

a moving unit configured to move the holder member;

a fixing member that fixes the holder member; and a first notification part configured to give a first notification in a case where a moving distance of the holder member by the moving unit performing to move the holder member is less than a predetermined value.

12. The printing apparatus according to claim 11, further comprising:

a cap member being capable of performing spacing operation to move from a capping position at which the cap member covers the ejection opening surface to an evacuate position at which the cap member does not abut on the ejection opening surface, wherein in a case where a moving distance of the holder member is larger than a first value based on a moving distance by which the holder member can move in a state where the holder member is fixed by the fixing member and less than a second value larger than the first value, separating operation of the cap member different from the spacing operation is performed.

13. The printing apparatus according to claim 11, further comprising:

a second notification part configured to give a second notification in a case where the printing apparatus is performing preparation for transport on a condition that a moving distance of the holder member by the moving unit performing to move the holder member is larger than or equal to the predetermined value.

14. The printing apparatus according to claim 13, further comprising:

a display unit, wherein at least one of the first notification part and the second notification part gives the notification to a user via the display unit.

15. A control method of a printing apparatus comprising:

a print head that ejects ink;

a holder member that holds the print head;

a moving unit configured to move the holder member; and a fixing member that fixes the holder member; the control method comprising:

giving a first notification in a case where a moving distance of the holder member by the moving unit performing to move the holder member is less than a predetermined value.

* * * * *